US005673849A

United States Patent [19]

Stone

[11] Patent Number: 5,673,849

[45] Date of Patent: Oct. 7, 1997

[54] FLIP-TOP RECLOSABLE CARTON AND BLANK FOR MAKING THE SAME

[75] Inventor: James L. Stone, Grand Rapids, Mich.

[73] Assignee: Tenneco Packaging, Evanston, Ill.

[21] Appl. No.: 581,003

[22] Filed: Jan. 3, 1996

Related U.S. Application Data

[63] Continuation-in-part of Ser. No. 501,996, Jul. 13, 1995, Pat. No. 5,505,374.

[51] Int. Cl.[6] ..... B65D 5/66

[52] U.S. Cl. ..... 229/227; 229/130; 229/145

[58] Field of Search ..... 229/130, 144, 229/145, 154, 226, 227, 905

[56] References Cited

U.S. PATENT DOCUMENTS

| | | | |
|---|---|---|---|
| Re. 26,471 | 10/1968 | Meyers . | |
| 1,017,728 | 2/1912 | Bartlett . | |
| 2,348,377 | 5/1944 | Goodyear . | |
| 2,367,476 | 1/1945 | Tyrseck . | |
| 2,369,387 | 2/1945 | Williamson et al. . | |
| 2,369,392 | 2/1945 | Ringler . | |
| 2,396,310 | 3/1946 | Yungblut . | |
| 2,403,698 | 7/1946 | Williamson et al. . | |
| 2,717,074 | 9/1955 | Williamson et al. . | |
| 2,836,343 | 5/1958 | Will . | |
| 2,881,967 | 4/1959 | Ringler . | |
| 2,939,621 | 6/1960 | Mittleman | 229/130 |
| 2,951,627 | 9/1960 | Wenzel . | |
| 3,140,809 | 7/1964 | Hickin et al. . | |
| 3,207,416 | 9/1965 | Koltz et al. . | |
| 3,432,090 | 3/1969 | Engel . | |
| 3,524,581 | 8/1970 | Buttery . | |
| 3,708,108 | 1/1973 | Rosenbure, Jr. . | |
| 3,756,501 | 9/1973 | Skillen et al. . | |
| 3,910,486 | 10/1975 | Stone . | |
| 3,963,173 | 6/1976 | Stone . | |
| 4,048,052 | 9/1977 | Tolaas . | |
| 4,083,455 | 4/1978 | Keating, Jr. . | |
| 4,102,457 | 7/1978 | Meyers . | |
| 4,127,229 | 11/1978 | Foccaforte . | |
| 4,136,816 | 1/1979 | Gardner | 229/144 |
| 4,141,449 | 2/1979 | Stone . | |
| 4,284,193 | 8/1981 | Roccaforte . | |
| 4,289,239 | 9/1981 | Meyers . | |
| 4,314,643 | 2/1982 | Forbes, Jr. . | |
| 4,531,669 | 7/1985 | Osborne . | |
| 4,542,847 | 9/1985 | Lindstrom . | |
| 4,679,694 | 7/1987 | Donohie et al. . | |
| 4,688,677 | 8/1987 | Roccaforte . | |
| 4,726,471 | 2/1988 | Whately et al. . | |
| 4,732,315 | 3/1988 | Gunn . | |
| 4,747,536 | 5/1988 | Wischusen, III | 229/130 |
| 4,768,703 | 9/1988 | Sosler et al. . | |
| 4,773,542 | 9/1988 | Schillinger et al. . | |
| 4,948,038 | 8/1990 | Moeller . | |
| 4,986,420 | 1/1991 | Gunn et al. . | |
| 5,092,516 | 3/1992 | Kastanek . | |
| 5,148,973 | 9/1992 | Zimmermann . | |
| 5,154,343 | 10/1992 | Stone . | |

(List continued on next page.)

FOREIGN PATENT DOCUMENTS

| | | |
|---|---|---|
| 1017728 | 9/1977 | Canada . |
| 1323608 | 10/1993 | Canada . |
| 2229996 | 3/1990 | United Kingdom . |

*Primary Examiner*—Gary E. Elkins
*Attorney, Agent, or Firm*—Arnold, White & Durkee

[57] ABSTRACT

A side-filled, flip-top reclosable carton composed of a unitary, continuous blank, comprises opposing top and bottom walls, opposing front and back walls, and opposing first and second side walls. The first and second side walls and the front wall include a continuous horizontal tear element for opening up the carton from a sealed form to form a lid hingedly attached to a base section. The first and second side walls include respective first and second top minor flaps hingedly connected to opposing ends of the top wall. The first and second side walls include respective first and second web flaps hingedly connected at upper edges thereof. The first web flap is hingedly connected to the first top minor flap along a first diagonal score line, and the second web flap is hingedly connected to the second top minor flap along a second diagonal score line.

21 Claims, 5 Drawing Sheets

U.S. PATENT DOCUMENTS 5,161,734 11/1992 Ruehl et al. .
5,209,394 5/1993 Griffiths et al. .
5,219,089 6/1993 Kiolbasa et al. .
5,236,123 8/1993 Stone et al. .
5,238,179 8/1993 Hart .
5,265,799 11/1993 Stone .
5,277,360 1/1994 DeMott .
5,299,732 4/1994 Armor et al. .
5,314,114 5/1994 Stone .
5,320,279 6/1994 Giblin et al. .
5,322,215 6/1994 Roccaforte .
5,328,091 7/1994 Koss .
5,373,960 12/1994 Gunn et al. .
5,439,133 8/1995 Stone .

Fig. 1
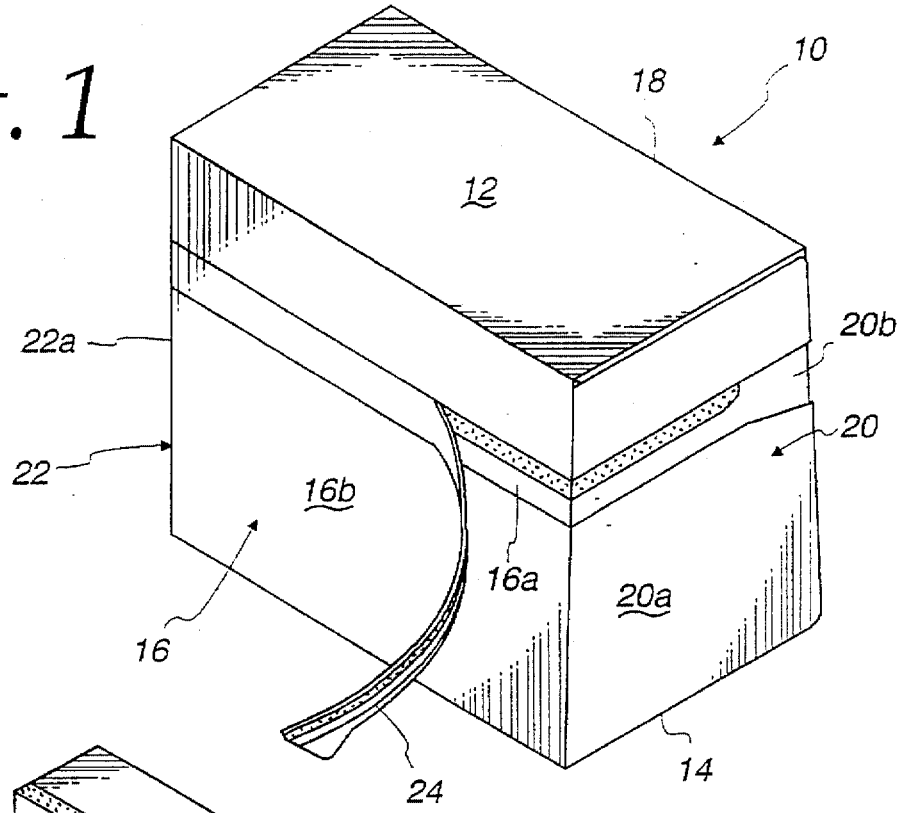
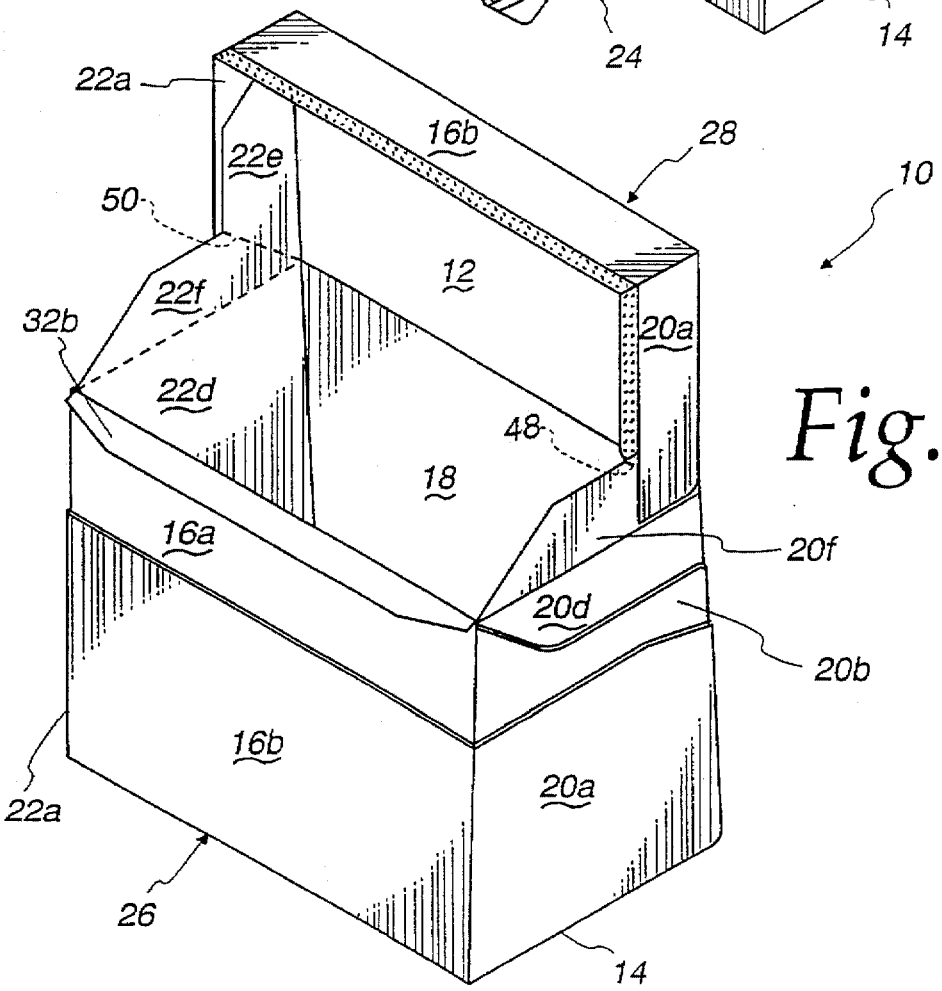
Fig. 2

FLIP-TOP RECLOSABLE CARTON AND BLANK FOR MAKING THE SAME

CROSS-REFERENCE TO RELATED APPLICATIONS

This application is a continuation-in-part of copending U.S. patent application Ser. No. 08/501,996, filed Jul. 13, 1995, U.S. Pat. No. 5,505,374 and entitled "Flip-Top Reclosable Carton and Method of Making the Same".

FIELD OF THE INVENTION

The present invention relates generally to flip-top reclosable cartons particularly adapted to storing powdered or granular materials. More specifically, the present invention relates to a specially-designed flip-top reclosable carton which can be manufactured with conventional form-fill-seal equipment using a conventional flap folding sequence. The flip-top reclosable carton employs a webbed flap feature to better orthogonalize adjacent panels of the carton during form-fill-seal operations, to provide the formed carton with improved sift-resistance, to improve the integrity and stability of the formed carton, and to snugly engage the lid and base of the carton when the lid is reclosed following use.

BACKGROUND OF THE INVENTION

In a variety of consumer packaging applications, it is important to supply paperboard or corrugated cardboard cartons which are capable of being conveniently, yet securely, opened and reclosed repeatedly. The ability to be repeatedly opened and closed down in a lockable manner is particularly important where the carton is used for storage of granular or powdered material, such as laundry detergent powder. Various approaches have been undertaken to address the repeated opening and closing requirements by means of carton designs using different types of interlocking flaps.

An exemplary reclosable carton design is disclosed in U.S. Pat. No. 5,154,343 to Stone ("Stone"). Stone discloses a flip-top reclosable carton which employs an integral tear strip as means by which a user may strip open the carton. Removing the tear strip delineates the carton into a lid and a base, where the lid is hingedly connected to a back wall of the base. After the tear strip is removed, the carton is opened by lifting the lid up. Subsequently, the carton is reclosed by pushing the lid back down to its original position. Repeated closing and positive locking of the carton is realized by means of snap engagement of a distal attachment portion on the lid and a proximal locking portion on the base.

In another carton design, locking of the lid and base is realized by a friction fit between the lid and a corresponding engaging portion of the carton base.

Paperboard or corrugated cardboard cartons are typically formed from rolls of board which are cut into "blanks." Score lines are scribed between sections of a blank to divide the blank into rectangular sections and to facilitate folding of these sections with respect to one another. In forming a carton from the blank, a top, side, or bottom panel of the carton is initially left unsealed so that the carton may be filled with a product through the unsealed panel. Once the carton is filled with the product, the carton is sealed and the filled carton is ready to be sold to a consumer.

The flip-top reclosable carton disclosed in Stone is a side-filled carton which is filled with a product through an unsealed side wall. The unsealed side wall of such a carton is subsequently sealed using a somewhat non-conventional folding sequence requiring specially-engineered form-fill-seal equipment. Each side wall of the carton in Stone, for example, is created from top and bottom minor flaps, a back major flap, and a pair of overlapping front major flaps. One of the front major flaps is associated with a front inner panel, while the other of the front major flaps is associated with a front outer panel. In one version, the foregoing flaps are folded inward by 90 degrees in the following sequence: bottom minor flap, back major flap, pair of overlapping front major flaps, and top minor flap. The use of this somewhat non-conventional flap folding sequence follows from the design of the carton in Stone. Like the carton in Stone, side-filled cartons using a friction-fit closure have historically been sealed using a somewhat non-conventional flap folding sequence due to the design of the various flaps used to form the side walls of these cartons. A need therefore exists for a side-filled, flip-top reclosable carton which can be sealed using a conventional flap folding sequence so that the carton is entirely compatible with conventional form-fill-seal equipment.

During form-fill-seal operations, adjacent carton panels are folded generally orthogonal to each other. For example, the front outer and inner panels and the back panel are orthogonal to the aforementioned flaps which form the side walls and are likewise orthogonal to the adjacent top and bottom panels. The top and bottom panels are also orthogonal to the flaps which form the side walls. Maintaining the orthogonality of the adjacent carton panels is desirable because it insures proper alignment of panels and flaps in the formed carton. Misaligned panels and flaps would result in a distorted carton. It is also important to maintain the front and back panels orthogonal to the top and bottom panels when a product is loaded into the carton through an unsealed side wall during fill operations in order to insure proper loading of the product. A need therefore exists for a carton which insures orthogonalization of adjacent carton panels during form-fill-seal operations.

As stated above, the sealed carton of the type in Stone is opened by removing the tear strip to delineate the carton into a lid and a base and by lifting the lid up. When the lid is lifted to the opened position, the lid may tend to return to the closed position due to the memory retained in the hinge which connects the lid to the base. Such a tendency for the lid to return to the closed position is undesirable as it impedes the ability of the consumer to remove the contained product from the carton. The consumer may need to grasp the lid with his or her hand in order to prevent the lid from closing. A need therefore exists for a reclosable carton which is capable of retaining the lid in the opened position without requiting the consumer to hold the lid open with his or her hand.

The opened carton in Stone is reclosed by pushing the lid back down to its original position. When the lid is in the closed position, it is desirable to create a snug fit between the lid and the base because it has been determined that the presence of such a snug fit provides consumers with a high comfort factor with respect to reclosure. Particularly, in applications where the reclosable carton is used to house granulated material such as laundry detergent and dishwashing detergent having a restricted storage life once the carton has been torn open, such a snug fit has been determined to provide an apparent sense of reassurance to consumers as to sift-resistance and retention of freshness, safety, or scent of the contained product. A need therefore exists for a reclosable carton which provides a snug fit between the lid and the base.

SUMMARY OF THE INVENTION

In one particular embodiment of the present invention, a side-filled, flip-top reclosable carton is composed of a unitary, continuous blank. The carton includes opposing top and bottom walls and opposing front and back walls bridging the opposing top and bottom walls. The front wall includes a front inner panel and a front outer panel. First and second top minor flaps extend from opposing ends of the top wall. First and second bottom minor flaps extend from opposing ends of the bottom wall. First and second back major flaps extend from opposing ends of the back wall. First and second wing flaps extend from opposing ends of the front inner panel. First and second front major flaps extend from opposing ends of the front outer panel. The first and second front major flaps and the front outer panel include a continuous horizontal tear strip for opening up the carton from a sealed form to form a lid hingedly attached to a base section. The first top and bottom minor flaps, the first front and back major flaps, and the first wing flap cooperate with each other to form a first side wall. Similarly, the second top and bottom minor flaps, the second front and back major flaps, and the second wing flap cooperate with each other to form a second side wall opposing the first side wall. The first and second side walls bridge the opposing top and bottom walls and bridge the opposing front and back walls.

In conjunction with strategic application of adhesive, the foregoing flaps of the carton are designed to permit sealing of the first and second side walls using a conventional flap folding sequence, thereby making the carton fully compatible with conventional form-fill-seal equipment. Heretofore, the use of such a conventional flap folding sequence has not been possible with existing side-filled, flip-top reclosable cartons due to the design of the flaps of those cartons.

To seal the side walls of the carton embodying the present invention, the first back major flap is folded inward approximately 90 degrees relative to the back wall. Adhesive is applied to an outer surface of the first back major flap. An upper portion of the first back major flap is free of the adhesive. The first top and bottom minor flaps are folded inward approximately 90 degrees relative to the respective top and bottom walls so that the adhesive attaches the first bottom minor flap to an outer surface of the first back major flap. The first top minor flap is in unattached contact with the first back major flap. Adhesive is also applied to inner surfaces of the first wing flap and the first front major flap. The first wing flap and the first front major flap are folded inward approximately 90 degrees relative to the respective front inner and outer panels so that the adhesive attaches the first wing flap to an outer surface of the first back major flap and attaches the first front major flap to outer surfaces of the first top and bottom minor flaps and to the outer surface of the first back major flap. The second flaps are folded and adhered in similar fashion to seal the second side wall of the carton.

The flip-top reclosable carton described above employs a webbed flap feature to better orthogonalize adjacent panels of the carton during form-fill-seal operations, to provide the formed carton with improved sift-resistance, to improve the integrity and stability of the formed carton, and to snugly engage the lid and base of the carton when the lid is reclosed following use. More specifically, first and second web flaps are hingedly connected to upper edges of the respective first and second back major flaps. The first web flap is hingedly connected to the first top minor flap along a first diagonal score line, while the second web flap is hingedly connected to the second top minor flap along a second diagonal score line. It is this web-like connection of the first and second web flaps to the respective first and second top minor flaps which creates the webbed flap feature of the present invention.

When the lid is in the closed position, the first and second top minor flaps abut and overlap the respective first and second web flaps. Also, the first top minor flap and the first web flap are trapped between the first front and back major flaps, and the second top minor flap and the second web flap are trapped between the second front and back major flaps. When the lid is rotated to the opened position, the first and second web flaps are pulled upward away from the respective first and second back major flaps by virtue of their connection to the respective first and second top minor flaps, which follow movement of the lid. The first and second web flaps rotate approximately 180 degrees about the upper edges of the respective first and second back major flaps so that the first and second web flaps, the first and second top minor flaps, and the first and second back major flaps are approximately coplanar with each other. The lid is propped up in the opened position by the first and second web flaps, which bear against the respective first and second top minor flaps along the respective first and second diagonal score lines.

In addition to providing a new and improved flip-top reclosable carton, the present invention is directed to the blank from which the carton is formed.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which:

FIG. 1 is a perspective view of a reclosable carton embodying the present invention, showing the carton in its closed form with a tear strip partially removed;

FIG. 2 is a perspective view of the reclosable carton in FIG. 1, showing the carton in its opened form with a lid raised upwardly from a base section;

Figure 3:
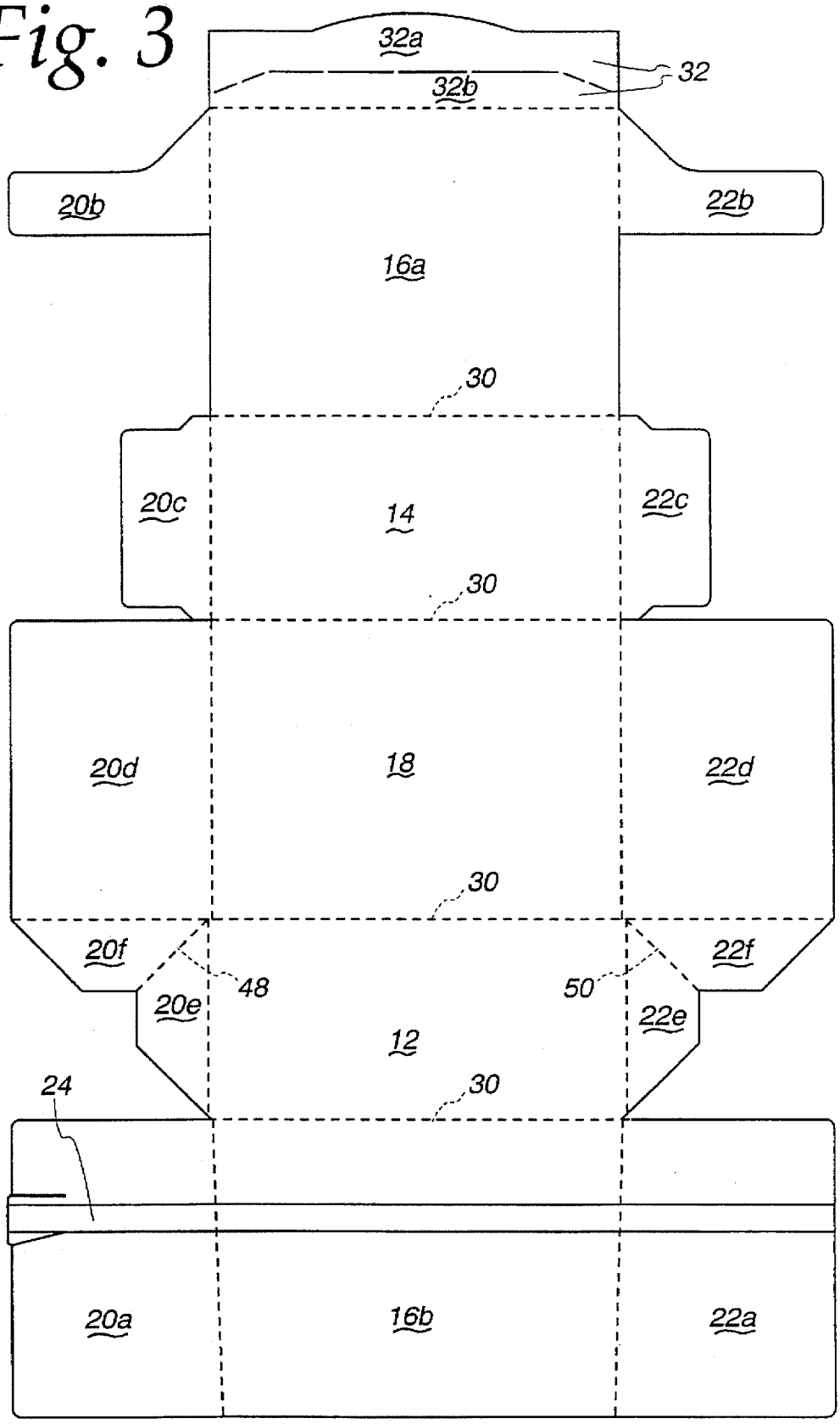
FIG. 3 is a plan view of the inside surface of a paperboard or corrugated cardboard blank used to form the carton in FIG. 1.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings, FIGS. 1 and 2 are perspective views of an exemplary side-filled, flip-top reclosable carton 10. FIG. 1 illustrates the carton 10 in closed form with a tear strip partially removed, and FIG. 2 illustrates the carton 10 in opened form following removal of the tear strip. The reclosable carton 10 in FIG. 1 is a six-sided parallelopiped enclosure formed of three pairs of opposing, generally rectangular walls. More specifically, the carton includes opposing top and bottom walls 12 and 14, opposing front and back walls 16 and 18, and opposing first and second side walls 20 and 22. As best shown in FIG. 2, the front wall 16 includes an inner panel 16*a* and an outer panel 16*b*. As described in detail below, various flaps are hingedly connected to opposing ends of the top and bottom walls 12 and 14 and are hingedly connected to opposing ends of the front and back walls 16 and 18. These flaps cooperate with each other to form the first and second side walls 20 and 22. The outermost flaps of the first and second side walls 20 and 22 are designated by the reference numerals 20*a* and 22*a*, respectively.

The outer front panel 16*b* and the outermost flaps 20*a* and 22*a* of the respective side walls 20 and 22 and, more specifically, the relative upper portions thereof, are provided with horizontal tear strip sections which effectively define an integral and continuous tear strip 24. The tear strip 24 effectively functions as means for convenient opening of the carton 10 once it has been filled with the requisite contents and sealed. Tearing or pulling away of the tear strip 24 as indicated in FIG. 1 effectively releases the sealed edges of the outermost side wall flaps 20*a* and 22*a* and the outer front panel 16*b* in order to delineate the carton 10 into a base section generally indicated as 26 in FIG. 2 and a lid generally indicated as 28 in FIG. 2. The arrangement is such that, once the tear strip 24 has been completely pulled away, the carton lid can be swung or raised upwardly away from the carton base section 26 by virtue of a hinged attachment of the horizontal edge of the top wall 12 to the corresponding horizontal edge of the back wall 18 of the carton 10.

Referring now to FIG. 3, there is illustrated a plan view of the inside surface of a unitary, continuous paperboard or corrugated cardboard blank used for forming the carton 10 described above in connection with FIGS. 1 and 2. Identical reference numerals are used in the figures to indicate corresponding portions of the blank and the carton 10. The blank includes five vertically aligned, substantially rectangular panels 16*a*, 14, 18, 12, and 16*b* hingedly connected along horizontal score lines 30 which facilitate folding of the carton panels relative to each other. With respect to the manner in which these panels interact to define the closed carton shown in FIG. 1, the panel 16*a* functions as the front inner panel, the panel 14 functions as the bottom wall, the panel 18 functions as the back wall, the panel 12 functions as the top wall, and the panel 16*b* functions as the front outer panel.

Each of the five main panels of the carton blank is provided with a pair of flaps hingedly connected along respective opposing vertical ends by means of corresponding score lines. More specifically, first and second wing flaps 20*b* and 22*b* extend from opposing ends of the front inner panel 16*a*. First and second bottom minor flaps 20*c* and 22*c* extend from opposing ends of the bottom wall panel 14. First and second back major flaps 20*d* and 22*d* extend from opposing ends of the back wall panel 18. First and second top minor flaps 20*e* and 22*e* extend from opposing ends of the top wall panel 12. First and second front major flaps 20*a* and 22*a* extend from opposing ends of the front outer panel 16*b*. First and second web flaps 20*f* and 22*f* extend from lower edges (as viewed in FIG. 3) of the respective first and second back major flaps 20*d* and 22*d*. Any of the aforementioned flaps which are visible in FIGS. 1 and 2 are labelled with the appropriate reference numerals.

The first and second web flaps 20*f* and 22*f* are hingedly connected to the respective first and second top minor flaps 20*e* and 22*e* along respective diagonal score lines 48 and 50. The diagonal score line 48 is preferably oriented at a 45 degree angle relative to each of the hinges which connect the flaps 20*e* and 20*f* to the respective top wall panel 12 and the first back major flap 20*d*. Similarly, the diagonal score line 50 is preferably oriented at a 45 degree angle relative to each of the hinges which connect the flaps 22*e* and 22*f* to the respective top wall panel 12 and the second back major flap 22*d*. It is the web-like hinged connection of the first and second web flaps 20*f* and 22*f* to the respective first and second top minor flaps 20*e* and 22*e* which creates the webbed flap feature of the present invention. The first and second web flaps 20*f* and 22*f* have approximately the same shape and dimensions as the respective first and second top minor flaps 20*e* and 22*e* such that when the carton 10 is closed, the first and second web flaps 20*f* and 22*f* substantially overlap the respective first and second top minor flaps 20*e* and 22*e*. Although such overlap is not visible in FIG. 1, such overlap is visible in FIGS. 9 and 13 which depict the carton 10 as it is being formed.

In the illustrative embodiment of FIG. 3, the first and second wing flaps 20*b* and 22*b*, the first and second back major flaps 20*d* and 22*d*, and the first and second front major flaps 20*a* and 22*a* have generally similar horizontal dimensions. However, the first and second bottom minor flaps 20*c* and 22*c* and the first and second top minor flaps 20*e* and 22*e* have horizontal dimensions which are substantially smaller than the horizontal dimensions of the other flaps.

The horizontal tear strip 24 extends integrally across the front outer panel 16*b* and its associated front major flaps 20*a* and 22*a*. The design and structure of the tear strip 24 and its operation in effective sealing and convenient tearing open of a carton of the type disclosed herein is fairly conventional and, accordingly, not described in detail herein. It suffices to state that the tear strip 24 is substantially in the form of a pair of guiding perforation-like (e.g., zipper perforation) or cut-scored parallel lines having a predefined depth of cut (at least about 30 percent) into the outer surfaces of the front outer panel 16*b* and its associated front major flaps 20*a* and 22*a*. The tear strip 24 optionally includes a reinforcing tape attached to its inner surface to prevent the strip from breaking apart as a result of the strip being removed from the carton 10 during the unsealing operation.

The blank optionally includes an extension flap 32 hingedly connected to the upper horizontal edge of the front inner panel 16*a* along a horizontal score line 34. The extension flap 32 includes a distal island portion 32*a* and a proximal hinged portion 32*b* which are linked together by means of weakening "nicks", whereby the distal island portion 32*a* may easily be separated from the proximal hinged portion 32*b*. In the carton 10 depicted in FIGS. 1 and 2, the distal island portion 32*a* is adhered to the inner surface of the front outer panel 16*b* above the tear strip 24. When the tear strip 24 is removed and the lid 28 is rotated away from the base section 26 as shown in FIG. 2, the distal island portion 32*a* separates from the proximal hinged portion 32*b* by breaking free of its restricting nicks and remains attached to the inner surface of the front outer panel 16*b*. Reclosure and positive locking of the lid 28 to the base section 26 in FIG. 2 is accomplished by pushing the lid 28 back down to its original position and by snap engagement of the distal island portion 32*a* and the proximal hinged portion 32*b*. Additional information concerning the foregoing type of positive locking arrangement may be obtained from U.S. Pat. Nos. 5,161,734; 5,154,343; 5,265,799; and 5,314,114, which are each fully incorporated herein by reference.

In an alternative embodiment, the carton 10 does not employ the extension flap 32, but rather locking of the lid 28 to the base section 26 is realized by a friction fit between the lid 28 and an upper marginal portions of the front inner panel 16*a*, the first back major flap 20*d*, and the second back major flap 22*d*.

Figure 4:
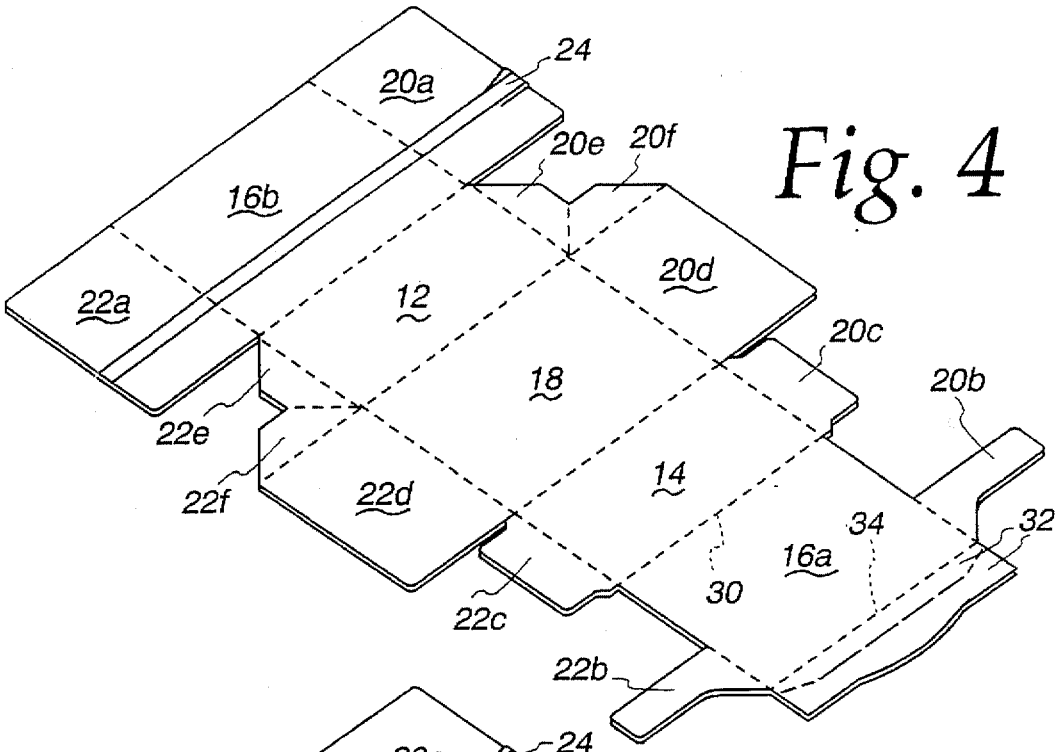
FIG. 4 is a perspective view of the blank used to form the carton in FIG. 1.
Figure 5:
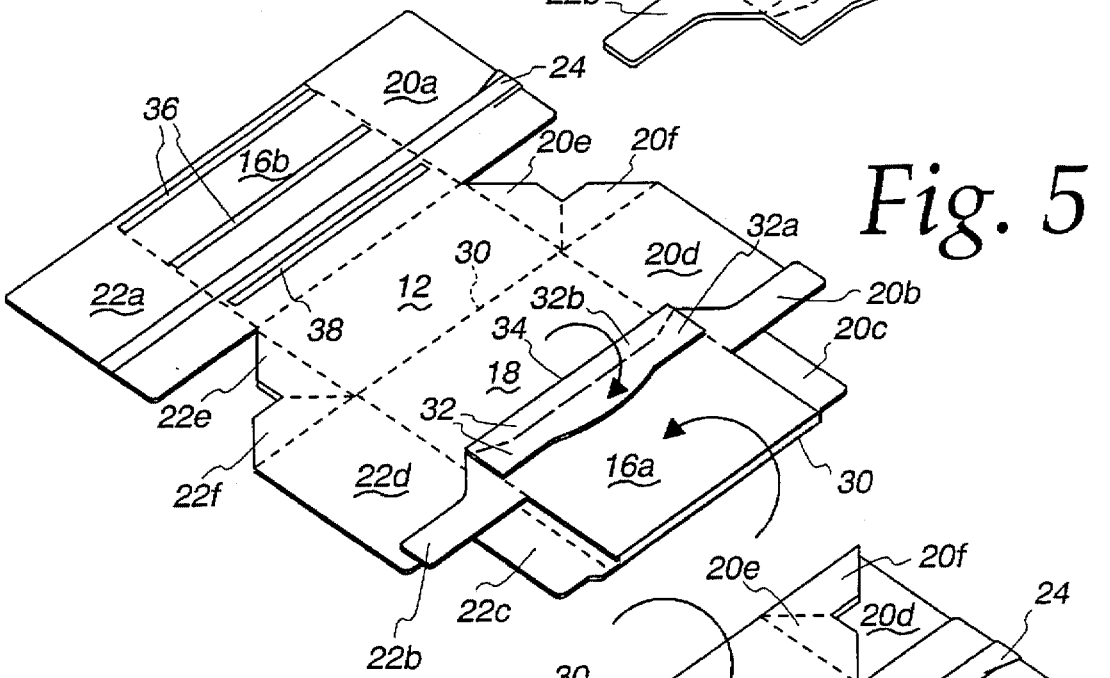
FIG. 5 is a perspective view of the blank in partially folded form.

FIGS. 4–14 illustrate the manner in which the carton 10 is formed from the unitary, continuous blank. FIG. 4 is a perspective view of the blank in unfolded form, and FIG. 5 is a perspective view of the blank is partially folded form. To realize the partially folded blank in FIG. 5, the front inner panel 16*a* is rotated 180 degrees relative to the bottom wall panel 14 about the score line 30 so that the inner surface of the front inner panel 16*a* is adjacent to the inner surface of the bottom wall panel 14. Also, the extension flap 32 is rotated 180 degrees relative to the front inner panel 16*a* about the score line 34 so that the outer surface of the extension flap 32 is adjacent to the outer surface of the front inner panel 16*a* (FIG. 5).

Figure 6:
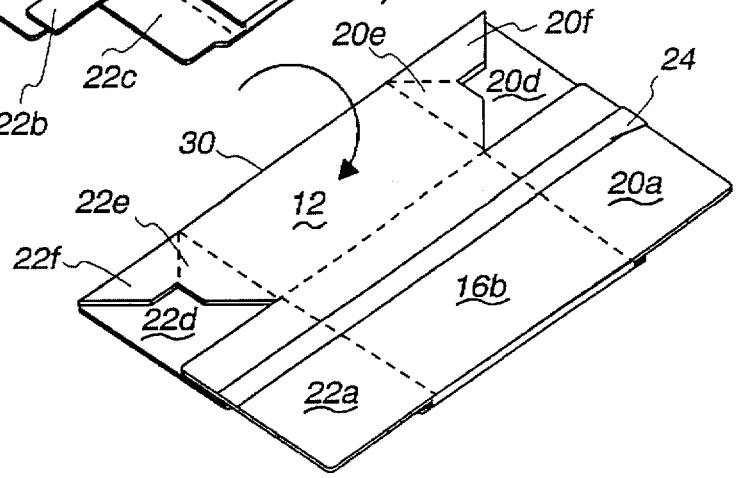
FIG. 6 is a perspective view of the carton in flattened (unerected) tubular form.

FIG. 6 is a perspective view of the carton 10 in flattened (unerected) tubular form. The flattened carton 10 in FIG. 6 is realized by first applying strips of adhesive 36 to the inner surface of the front outer panel 16*b* beneath the tear strip 24. A strip of adhesive 38 is also applied to the inner surface of the front outer panel 16*b* just above the tear strip 24. Next, the top wall panel 12 is rotated 180 degrees relative to the back wall panel 18 about the score line 30 so that the inner surface of the top wall panel 12 is adjacent to the inner surface of the back wall panel 18. The strips of adhesive 36 bond the inner surface of the front outer panel 16*b* to the outer surface of the front inner panel 16*a*. The strip of adhesive 38 is properly positioned to bond the inner surface of the distal island portion 32*a* to the inner surface of the front outer panel. The proximal hinged portion 32*b* remains free of adhesive.

Figure 7:
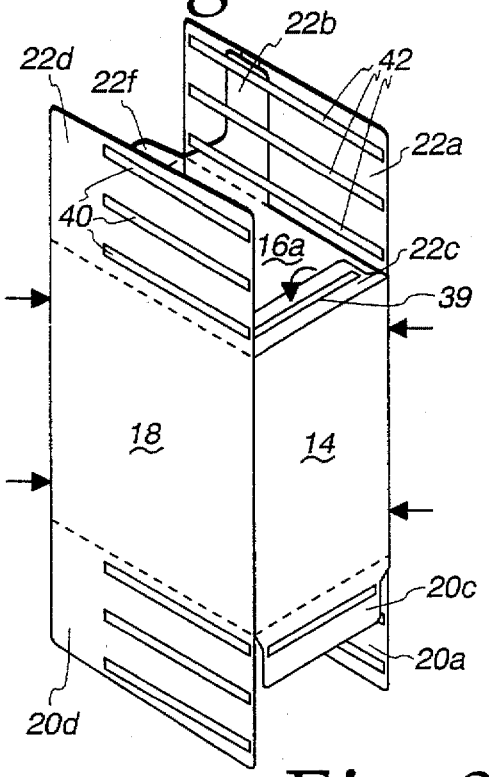
FIG. 7 is a perspective view of the carton in the form of an erected, open-sided rectangular sleeve.

FIG. 7 is a perspective view of the carton 10 in the form of an erected, open-sided rectangular sleeve. To realize the rectangular sleeve from the unerected carton in FIG. 6, pressure is applied to opposing sides of the flattened carton 10 as depicted by the arrows in FIG. 7. Next, one of the open sides of the carton 10 is sealed using a conventional flap folding sequence, in conjunction with strategically applied adhesive, to create a sealed side wall. FIGS. 7–10 show the flap folding sequence and adhesive application with respect to the flaps 22*a*, 22*b*, 22*c*, 22*d*, 22*e*, and 22*f*, which are used to form the side wall 22 of the carton 10. The flaps are configured so that the strategic application of adhesive allows the flaps to be folded to form the side wall 22 using a conventional flap folding sequence.

Figure 9:
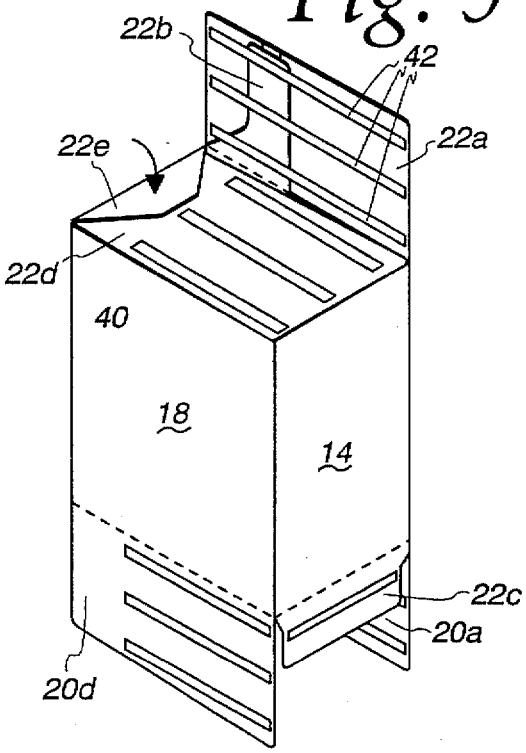

In FIG. 7 adhesive 39 is applied to the outer surface of the second bottom minor flap 22*c*. Also, adhesive 40 is optionally applied to a substantial portion of the outer surface of the second back major flap 22*d*, except for a narrow left portion (as viewed in FIG. 7) which remains free of the adhesive. Adhesive is not applied to this narrow left portion so that the second web flap 22*f* does not adhere to the second back major flap 22*d* when folded over as shown in FIG. 9. Therefore, the narrow left portion of the second back major flap 22*d* which remains free of adhesive should be sufficiently large to accommodate the folded second web flap 22*f* without adhering thereto.

In addition to the adhesive 39 and 40, adhesive 42 is applied to the inner surfaces of the second front major flap 22*a* and the second wing flap 22*b*. As the second wing flap 22*b* overlaps the second front major flap 22*a* when the adhesive 42 is applied, the shielded portion of the second front major flap 22*a* beneath and abutting the second wing flap 22*b* is free of the adhesive. Therefore, the second wing flap 22*b* is not adhered to the second front major flap 22*a*. Since the tear strip 24 on the second front major flap 22*a* is immediately adjacent to the second wing flap 22*b*, it is desirable to keep the second wing flap 22*b* unattached to the second front major flap 22*a* to facilitate removal of the tear strip 24 and to permit subsequent opening of the lid 28.

Figure 8:
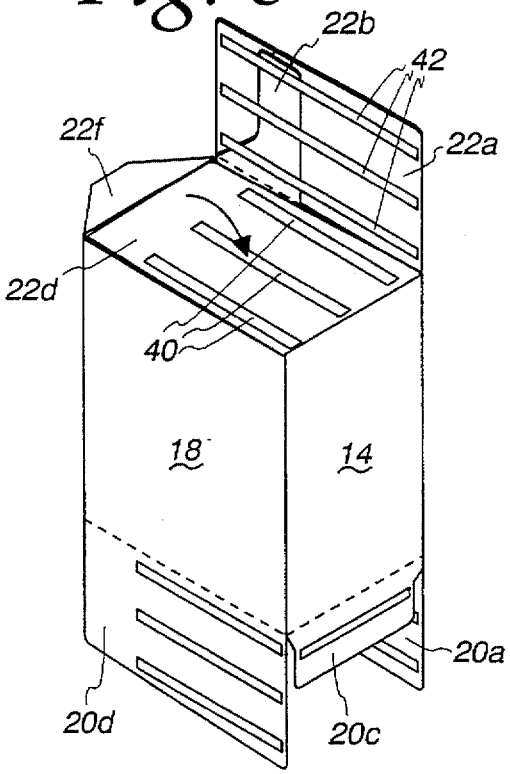
FIGS. 8, 9, and 10 are perspective views of the erected carton showing the flap folding sequence for sealing a first open side of the open-sided rectangular sleeve in FIG. 7.

Following the application of the adhesive 39, 40, and 42 as described above, the flaps 22*a*, 22*b*, 22*c*, 22*d*, 22*e*, and 22*f* are folded using a conventional flap folding sequence implemented with conventional form-fill-seal equipment. In particular, the second bottom minor flap 22*c* is rotated inward approximately 90 degrees relative to the bottom wall panel 14 (FIG. 7). Next, the second top minor flap 22*e* is rotated outward approximately 90 degrees relative to the top wall panel 12 (FIG. 8). Due to the hinged connection between the second top minor flap 22*e* and the second web flap 22*f* along the diagonal score line 50 (see FIG. 3), such outward rotation of the second top minor flap 22*e* pulls the second web flap 22*f* and the second back major flap 22*d* inward (FIG. 8). The second back major flap 22*d* is rotated inward approximately 90 degrees relative to the back wall panel 18, and the second web flap 22*f* substantially overlaps and conceals the second top minor flap 22*e* (FIG. 8). The adhesive 39 (see FIG. 8) attaches the outer surface of the second bottom minor flap 22*c* to the inner surface of the second back major flap 22*d*. Next, the second top minor flaps 22*e* and the second web flap 22*f* are simultaneously rotated inward approximately 90 degrees relative to the top wall panel 12 (FIG. 9). The second web flap 22*f* remains unattached to the second back major flap 22*d* due to the lack of adhesive therebetween.

Figure 10:
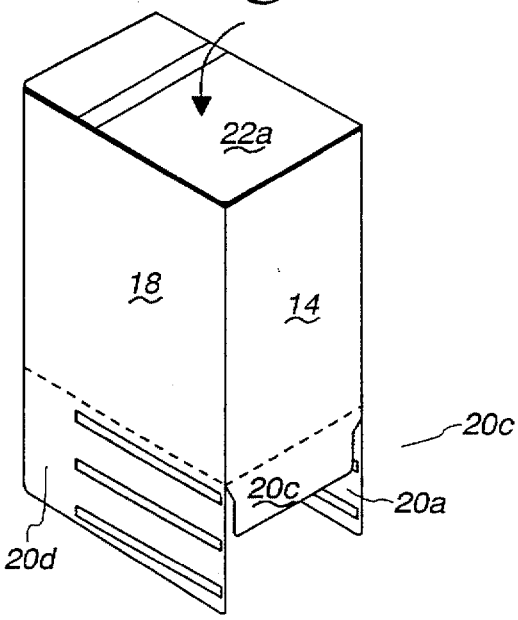

The final step in the flap folding sequence is to rotate the second front major flap 22*a* and the overlapping second wing flap 22*b* inward approximately 90 degrees relative to the respective front outer panel 16*b* and front inner panel 16*a* (FIG. 10). As the second wing flap 22*b* is disposed inwardly adjacent to the second front major flap 22*a*, folding the second front major flap 22*a* causes the second wing flap 22*b* to fold in tandem therewith. The adhesive 42 adheres the inner surface of the second front major flap 22*a* to the outer surfaces of the second top minor flap 22*e* and the second back major flap 22*d*. The adhesive 42 also adheres the inner surface of the second wing flap 22*b* to the outer surface of the second back major flap 22*d*. The second wing flap 22*b* is specially profiled so that when the second wing flap 22*b* is folded inward and attached to the second back major flap 22*d*, the second wing flap 22*b* does not overlap the second top minor flap 22*e* and the second web flap 22*f*. Rather, the second wing flap 22*b* is immediately adjacent to the second top minor flap 22*e* and the second web flap 22*f*. The curvilinear edge profile of second wing flap 22*b* substantially matches the curvilinear edge profiles of the second top minor flap 22e and the second web flap 22f so that the profiled edge of the second wing flap 22b practically or actually abuts the profiled edges of the second top minor flap 22e and the second web flap 22f.

Figure 11:
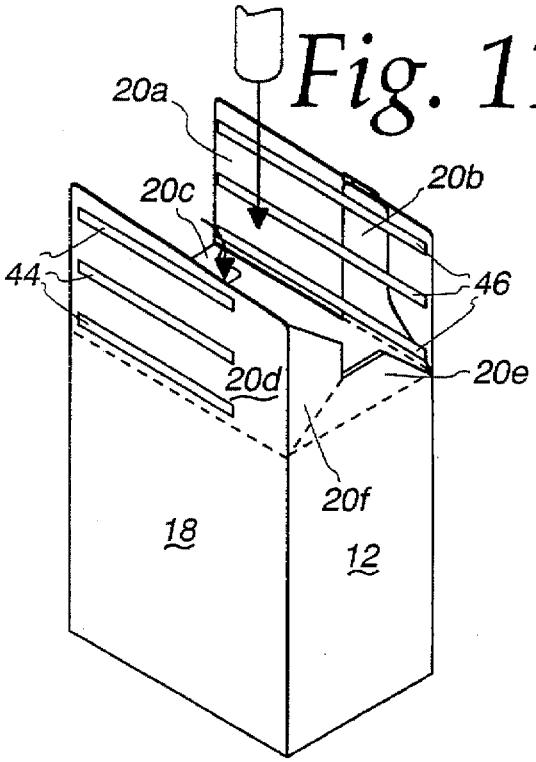
FIG. 11 is a perspective view of the erected carton showing the carton being filled through a second open side of the open-sided rectangular sleeve in FIG. 7.

After sealing the second side wall 22 of the carton 10 as illustrated in FIG. 10, a product such as granular detergent is loaded into the carton 10 via the open side thereof. In FIG. 11 this open side is the unsealed first side wall 20. The arrow in FIG. 11 indicates the loading of the product into the carton via this unsealed first side wall 20.

After the carton 10 is filled with the product, the first side wall 20 is sealed in a similar manner used to seal the side wall 22. The sealing process employs a conventional flap folding sequence, in conjunction with strategically applied adhesive. FIGS. 11–14 show the flap folding sequence and adhesive application with respect to the flaps 20a, 20b, 20c, 20d, 20e, and 20f, which are used to form the side wall 20 of the carton 10. The flaps are configured so that the strategic application of adhesive allows the flaps to be folded to form the side wall 20 using a conventional flap folding sequence.

Figure 13:
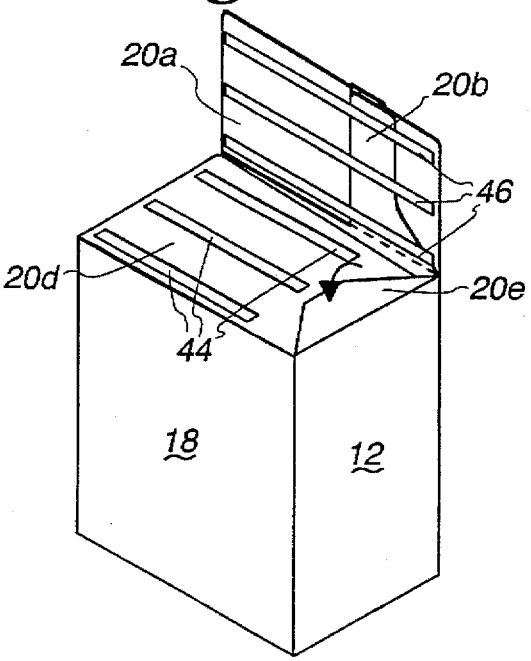

In FIG. 11 adhesive (not visible in FIG. 11) is applied to the outer surface of the first bottom minor flap 20c. Also, adhesive 44 is optionally applied to a substantial portion of the outer surface of the first back major flap 20d, except for a narrow right portion (as viewed in FIG. 11) which remains free of the adhesive. Adhesive is not applied to this narrow fight portion so that the first web flap 20f does not adhere to the first back major flap 20d when folded over as shown in FIG. 13. Therefore, the narrow right portion of the first back major flap 20d which remains free of adhesive should be sufficiently large to accommodate the folded first web flap 20f without adhering thereto.

In addition to the adhesive 44 and the adhesive on the first bottom minor flap 20c, adhesive 46 is applied to the inner surfaces of the first front major flap 20a and the first wing flap 20b. As the first wing flap 20b overlaps the first front major flap 20a when the adhesive 46 is applied, the shielded portion of the first front major flap 20a beneath and abutting the first wing flap 20b is free of the adhesive. Therefore, the first wing flap 20b is not adhered to the first front major flap 20a. Since the tear strip 24 on the first front major flap 20a is immediately adjacent to the first wing flap 20b, it is desirable to keep the first wing flap 20b unattached to the first front major flap 20a to facilitate removal of the tear strip 24 and to permit subsequent opening of the lid 28.

Figure 12:
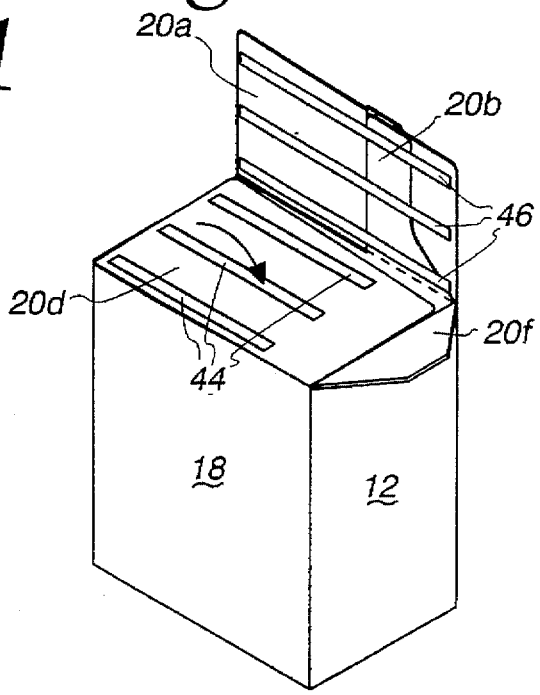
FIGS. 12, 13, and 14 are perspective views of the erected carton showing the flap folding sequence for sealing the second open side of the open-sided rectangular sleeve in FIG. 7.

Following the application of the adhesive as described above, the flaps 20a, 20b, 20c, 20d, 20e, and 20f are folded using a conventional flap folding sequence implemented with conventional form-fill-seal equipment. In particular, the first bottom minor flap 20c is rotated inward approximately 90 degrees relative to the bottom wall panel 14 (FIG. 11). Next, the first top minor flap 20e is rotated outward approximately 90 degrees relative to the top wall panel 12 (FIG. 12). Due to the hinged connection between the first top minor flap 20e and the first web flap 20f along the diagonal score line 48 (see FIG. 3), such outward rotation of the first top minor flap 20e pulls the first web flap 20f and the first back major flap 20d inward (FIG. 12). The first back major flap 20d is rotated inward approximately 90 degrees relative to the back wall panel 18, and the first web flap 20f substantially overlaps and conceals the first top minor flap 20e (FIG. 12). The adhesive on the first bottom minor flap 20c attaches the outer surface of the first bottom minor flap 20c to the inner surface of the first back major flap 20d. Next, the first top minor flaps 20e and the first web flap 20f are simultaneously rotated inward approximately 90 degrees relative to the top wall panel 12 (FIG. 13). The first web flap 20f remains unattached to the first back major flap 20d due to the lack of adhesive therebetween.

Figure 14:
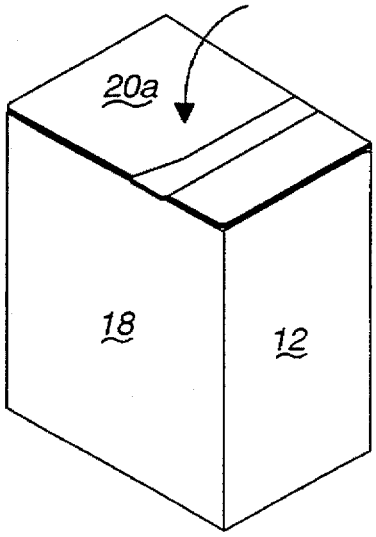

The final step in the flap folding sequence is to rotate the first front major flap 20a and the overlapping first wing flap 20b inward approximately 90 degrees relative to the respective front outer panel 16b and front inner panel 16a (FIG. 14). As the first wing flap 20b is disposed inwardly adjacent to the first front major flap 20a, folding the first front major flap 20a causes the first wing flap 20b to fold in tandem therewith. The adhesive 46 adheres the inner surface of the first front major flap 20a to the outer surfaces of the first top minor flap 20e and the first back major flap 20d. The adhesive 46 also adheres the inner surface of the first wing flap 20b to the outer surface of the first back major flap 20d. The first wing flap 20b is specially profiled so that when the first wing flap 20b is folded inward and attached to the first back major flap 20d, the first wing flap 20b does not overlap the first top minor flap 20e and the first web flap 20f. Rather, the first wing flap 20b is immediately adjacent to the first top minor flap 20e and the first web flap 20f. The curvilinear edge profile of first wing flap 20b substantially matches the curvilinear edge profiles of the first top minor flap 20e and the first web flap 20f so that the profiled edge of the first wing flap 20b practically or actually abuts the profiled edges of the first top minor flap 20e and the first web flap 20f.

Sealing the first side wall 20 as described above produces the fully sealed carton 10 depicted in FIG. 14. While the flaps of the carton 10 are folded to seal the side walls 20 and 22 and while the carton 10 is filled with a product as shown in FIG. 11, the first and second web flaps 20f and 22f orthogonalize adjacent panels of the carton 10. For example, as best shown in FIG. 11, the hinged connection between the first web flap 20f and the first top minor flap 20e maintains the top wall panel 12 orthogonal to the back wall panel 18. This, in turn, keeps other adjacent panels of the carton 10 orthogonal to each other so that the carton 10 does not deviate from its rectangular configuration.

When the lid 28 of the flip-top reclosable carton 10 in FIG. 1 is in the closed position, the first and second top minor flaps 20e and 22e abut and overlap the respective first and second web flaps 20f and 22f. Also, the first top minor flap 20e and the first web flap 20f are trapped between the first front and back major flaps 20a and 20d, and the second top minor flap 22e and the second web flap 22f are trapped between the second front and back major flaps 22a and 22d. Such trapping of the flaps 20e, 20f, 22e, and 22f creates a snug fit between the lid 28 and the base 26.

To open the flip-top reclosable carton 10, the tear strip 24 is removed (FIG. 1) and the lid 28 is raised upwardly from the base 26 (FIG. 2). When the lid 28 is raised upwardly from the base 26 in FIG. 2, the first and second web flaps 20f and 22f are pulled upward away from the respective first and second back major flaps 20d and 22d by virtue of their hinged connection to the respective first and second top minor flaps 20e and 22e, which follow movement of the lid 28. As described previously, the first and second top minor flaps 20e and 22e are adhered to the lid portions of the inner surfaces of the respective first and second front major flaps 20a and 22a. Therefore, the first and second top minor flaps 20e and 22e steadfastly follow movement of the lid 28.

As the lid 28 is opened, the first and second web flaps 20f and 22f rotate approximately 180 degrees about the upper edges of the respective first and second back major flaps 20d and 22d. While the first and second web flaps 20f and 22f are pulled upward by the respective first and second top minor flaps 20*e* and 22*e*, the lid portions of the first and second front major flaps 20*a* and 22*a* near the diagonal score lines 48 and 50 (FIG. 3) are flared outwardly away from the carton 10. The amount of outward flaring is greatest when the first and second web flaps 20*f* and 22*f* are parallel to the bottom wall 14, which corresponds to the point at which the lid 28 is approximately at a 45 degree angle relative to the base 26. The first and second back major flaps 20*d* and 22*d* remain fairly rigid, i.e. flex minimally inward, as the lid 28 is raised upwardly to the opened position in FIG. 2. In the opened position the lid 28 is oriented at an angle of approximately 90 degrees relative to the base 26. If the carton 10 contains granular products, the hinged connections of the first and second web flaps 20*f* and 22*f* to the respective first and second top minor flaps 20*e* and 22*e* provide the carton 10 with substantial sift-resistance, particularly near the rear corners of the carton 10. It is at these rear corners that the hinged connections inhibit the granular products from escaping the carton 10.

When the lid 28 is in the opened position in FIG. 2, the first and second web flaps 20*f* and 22*f*, the first and second top minor flaps 20*e* and 22*e*, and the first and second back major flaps 20*d* and 22*d* are approximately coplanar with each other. The lid 28 is propped up in the opened position by the first and second web flaps 20*f* and 22*f*, which bear against the respective first and second top minor flaps 20*e* and 22*e* the respective first and second diagonal score lines 48 and 50. The propped lid 28 stays open without requiring a consumer to hold the lid 28 with his or her hand. In order to facilitate access to the product within the carton 10, the consumer may rapture the diagonal score lines 48 and 50 connecting the first and second web flaps 20*f* and 22*f* to the respective first and second top minor flaps 20*e* and 22*e*. To rupture these diagonal score lines 48 and 50, the consumer can force the lid 28 open beyond the 90 degree angle relative to the base 26. The diagonal score lines 48 and 50 are sufficiently weak that the consumer need not apply an undue amount of opening force to the lid 28 to break these score lines.

To reclose the carton 10, the lid 28 is returned to its original closed position. The lid 28 is maintained in this closed position either by snap engagement of the distal island portion 32*a* and the proximal hinged portion 32*b* or by frictional engagement of the lid 28 and upper marginal portions of the base 26. While reclosing the lid 28, the first and second top minor flaps 22*e* and 22*f* force the first and second web flaps 20*f* and 22*f* to rotate approximately 180 degrees downward about the upper edges of the respective first and second back major flaps 20*d* and 22*d*. The sides of the lid 28 once again flare outward during this reclosure. If the diagonal score lines 48 and 50 are ruptured and the first and second web flaps 20*f* and 22*f* are only hinged to the respective first and second back major flaps 20*d* and 22*d*, reclosing the lid 28 causes the sides of the lid 28 to contact and push downward on the freely hinged web flaps 20*f* and 22*f* such that the web flaps 20*f* and 22*f* are rotated approximately 180 degrees downward about the upper edges of the respective first and second back major flaps 20*d* and 22*d*. With the lid 28 back in the closed position, the first top minor flap 20*e* and the first web flap 20*f* are trapped between the first front and back major flaps 20*a* and 20*d*, and the second top minor flap 22*e* and the second web flap 22*f* are trapped between the second front and back major flaps 22*a* and 22*d*.

It can be seen from the foregoing detailed description and the drawings that the carton 10 is uniquely designed and adhesive is strategically applied thereto so as to permit the use of a conventional flap folding sequence to seal the first and second side walls 20 and 22 of the carton 10 during the carton manufacturing process. This conventional flap folding sequence, in turn, allows the carton 10 to be produced using conventional form-fill-seal equipment. Companies need not modify their existing form-fill-seal equipment or purchase specially-designed form-fill-seal equipment in order to seal the carton 10. This results in a significant cost-savings to these companies.

While the present invention has been described with reference to one or more particular embodiments, those skilled in the art will recognize that many changes may be made thereto without departing from the spirit and scope of the present invention. For example, the front outer panel 16*b* and the first and second front major flaps 20*a* and 22*a* may be modified so that they terminate short of the bottom wall 14. Such a partial front outer panel and partial front major flaps may, for example, extend from the top wall 12 to just below the tear strip 24. To compensate for the shortened front major flaps, the first and second wing flaps 20*b* and 22*b* are increased in length so that they substantially extend to the bottom wall 14. The portion of the partial front outer panel below the tear strip 24 is attached to the front inner panel 16*a*. Likewise, the portions of the first and second front major flaps just below the tear strip 24 are attached to the lengthened first and second wing flaps, respectively. Providing the partial front outer panel and the partial front major flaps reduces the amount of paperboard used to manufacture the carton 10, and this paperboard savings reduces the cost of manufacturing the carton 10.

Each of these embodiments and obvious variations thereof is contemplated as falling within the spirit and scope of the claimed invention, which is set forth in the following claims.

What is claimed is:

1. A side-filled, flip-top reclosable carton composed of a unitary, continuous blank, comprising:

opposing top and bottom walls;

opposing front and back walls bridging said opposing top and bottom walls, said front wall including a front inner panel and a front outer panel;

first and second top minor flaps extending from opposing ends of said top wall;

first and second bottom minor flaps extending from opposing ends of said bottom wall;

first and second back major flaps extending from opposing ends of said back wall;

first and second wing flaps extending from opposing ends of said front inner panel;

first and second front major flaps extending from opposing ends of said front outer panel, said first and second front major flaps and said front outer panel including a continuous horizontal tear element for opening up the carton from a sealed form to form a lid hingedly attached to a base section; and first and second web flaps extending from upper edges of said respective first and second back major flaps, said first web flap being hingedly connected to said first top minor flap along a first diagonal score line, said second web flap being hingedly connected to said second top minor flap along a second diagonal score line;

said first top and bottom minor flaps, said first front and back major flaps, said first wing flap, and said first web flap cooperating with each other to form a first side wall;

said second top and bottom minor flaps, said second front and back major flaps, and said second wing flap cooperating with each other to form a second side wall opposing said first side wall.

2. The carton of claim 1, wherein said first top minor flap and said first web flap are disposed between said first front and back major flaps, and wherein said second top minor flap and said second web flap are disposed between said second front and back major flaps.

3. The carton of claim 2, wherein said first top minor flap abuts and substantially overlaps said first web flap, and wherein said second top minor flap abuts and substantially overlaps said second web flap.

4. The carton of claim 3, wherein said first top minor flap abuts said first front major flap and said first web flap abuts said first back major flap, and wherein said second top minor flap abuts said second front major flap and said second web flap abuts said second back major flap.

5. The carton of claim 1, wherein said lid is rotatable between a closed position and an opened position, and wherein rotating said lid to said opened position causes said first and second web flaps to rotate approximately 180 degrees upward away from said respective first and second back major flaps.

6. The carton of claim 1, wherein said first top minor flap, said first web flap, and said first back major flap are generally coplanar when said lid is in said opened position, and wherein said second top minor flap, said second web flap, and said second back major flap are generally coplanar when said lid is in said opened position, said first and second web flaps propping said lid in said opened position.

7. The carton of claim 1, wherein said propped open lid is oriented at an angle of approximately 90 degrees relative to said base section.

8. The carton of claim 1, wherein said first and second diagonal score lines intersect said back wall.

9. The carton of claim 1, wherein said first and second diagonal score lines intersect a hinge connecting said lid to said base section.

10. A side-filled, flip-top reclosable carton composed of a unitary, continuous blank, comprising:

opposing top and bottom walls;

opposing front and back walls bridging said opposing top and bottom walls; and opposing first and second side walls bridging said opposing top and bottom walls and bridging said opposing front and back walls, said first and second side walls and said front wall including a continuous horizontal tear element for opening up the carton from a sealed form to form a lid hingedly attached to a base section, said first and second side walls including respective first and second top minor flaps hingedly connected to opposing ends of said top wall, said first and second side walls including respective first and second web flaps hingedly connected at upper edges thereof, said first web flap being hingedly connected to said first top minor flap along a first diagonal score line, said second web flap being hingedly connected to said second top minor flap along a second diagonal score line.

11. The carton of claim 10, wherein said lid is rotatable between a closed position and an opened position, wherein when said lid is in said closed position, said first top minor flap and said first web flap abut and overlap each other, and said second top minor flap and said second web flap abut and overlap each other, and wherein when said lid is in said opened position, said first top minor flap and said first web flap are non-overlapping and generally coplanar, and said second top minor flap and said second web flap are non-overlapping and generally coplanar.

12. The carton of claim 11, wherein when said lid is in said opened position, said first and second web flaps prop said lid in said opened position.

13. The carton of claim 12, wherein said propped open lid is oriented at an angle of approximately 90 degrees relative to said base section.

14. The carton of claim 10, wherein said first and second diagonal score lines intersect said back wall.

15. The carton of claim 14, wherein said first and second diagonal score lines intersect a hinge connecting said lid to said base section.

16. A unitary, continuous blank for forming a side-filled, flip-top reclosable carton having opposing top and bottom walls, opposing front and back walls, and opposing first and second side walls, said blank comprising:

at least five panels hingedly connected to each other along generally horizontal fold lines, each of said panels including a pair of opposing vertical edges, said panels including a pair of front panels for forming said front wall, a back panel for forming said back wall, a top panel for forming said top wall, and a bottom panel for forming said bottom wall, said top panel being hingedly connected to said back panel; and a plurality of side closure flaps hingedly connected to said panels along said pairs of opposing vertical edges, said plurality of side closure flaps forming said opposing first and second side walls of said carton, said plurality of side closure flaps including first and second top minor flaps hingedly connected to said top panel, said plurality of side closure flaps including first and second back major flaps hingedly connected to said back panel, said plurality of side closure flaps including first and second web flaps hingedly connected to lower horizontal edges of said respective first and second back major flaps, said first and second web flaps being hingedly connected to said respective first and second top minor flaps along respective first and second diagonal score lines.

17. The blank of claim 16, wherein said first and second diagonal score lines are oriented at an angle of approximately 45 degrees relative to said respective opposing vertical edges of said top panel.

18. The blank of claim 16, wherein one of said front panels is connected to said bottom panel, said bottom panel is connected to said back panel, said back panel is connected to said top panel, and said top panel is connected to said other of said front panels.

19. The blank of claim 18, wherein said one of said front panels forms an inner layer of said front wall and said other of said front panels forms an outer layer of said front wall.

20. The blank of claim 19, wherein said plurality of side closure flaps includes first and second front major flaps hingedly connected to said pair of opposing edges of said other of said front panels, and wherein said other of said front panels and said first and second front major flaps include a continuous horizontal tear element.

21. The blank of claim 16, wherein said first and second web flaps have approximately the same shape and dimensions as said respective first and second top minor flaps.

* * * * *